US006400082B1

(12) United States Patent
Chikazawa

(10) Patent No.: US 6,400,082 B1
(45) Date of Patent: Jun. 4, 2002

(54) AC PLASMA DISPLAY PANEL HAVING ELECTRODE SETS INCLUDING TRANSPARENT PROTRUSIONS

(75) Inventor: Yoshiharu Chikazawa, Yokohama (JP)

(73) Assignee: Thomson Licensing, S. A., Boulogne Billancourt (FR)

( * ) Notice: Subject to any disclaimer, the term of this patent is extended or adjusted under 35 U.S.C. 154(b) by 0 days.

(21) Appl. No.: 09/272,006

(22) Filed: Mar. 18, 1999

(30) Foreign Application Priority Data

Mar. 23, 1998 (EP) ..... 98400676

(51) Int. Cl.[7] ..... H01J 17/49
(52) U.S. Cl. ..... 313/584; 313/582; 313/495
(58) Field of Search ..... 345/60–72; 313/581–587, 313/495, 496, 497

(56) References Cited

U.S. PATENT DOCUMENTS

| | | | | | |
|---|---|---|---|---|---|
| 4,190,788 | A | * | 2/1980 | Yoshikawa et al. | 315/169.4 |
| 5,066,890 | A | * | 11/1991 | Salavin et al. | 313/585 |
| 5,182,489 | A | | 1/1993 | Sano | 313/485 |
| 5,889,365 | A | * | 3/1999 | Tanabe | 313/582 |
| 5,900,694 | A | * | 5/1999 | Matasuzaki et al. | 313/484 |
| 5,962,974 | A | * | 10/1999 | Komaki et al. | 313/582 |
| 6,013,983 | A | * | 1/2000 | Asano et al. | 313/581 |
| 6,084,349 | A | * | 7/2000 | Ueoka et al. | 313/587 |

FOREIGN PATENT DOCUMENTS

| | | | |
|---|---|---|---|
| EP | 0 742 571 A | 11/1996 | H01J/17/48 |
| JP | 02 168534 A | 6/1990 | H01J/17/49 |

OTHER PUBLICATIONS

* Patent Abstracts of Japan, vol. 014, No. 433 (E–0979), Sep. 17, 1990.

EPO Search Report dated: Jul. 31, 1998.

* cited by examiner

*Primary Examiner*—Nimeshkumar D. Patel
*Assistant Examiner*—Mariceli Santiago
(74) *Attorney, Agent, or Firm*—Joseph S. Tripoli; Dennis H. Irlbeck; Carlos M. Herrera

(57) ABSTRACT

A plasma display panel having a back substrate, a first set of parallel electrodes associated to the back substrate, a front transparent substrate, a second set of electrodes associated to the front substrate, the electrodes of the second set having a direction which is transverse with respect to the direction of the electrodes of the first set, and partition walls which are situated between the back and the front substrates, and extend in the direction of the second set of electrodes.

This display is characterized in that:

each electrode of the second set faces the edge of a corresponding partition wall, and each electrode of the second set comprises, for each cell, a transparent protrusion extending towards the side of the partition wall corresponding to this cell.

The display may be of the matrix type or of the coplanar type.

11 Claims, 4 Drawing Sheets

AC PLASMA DISPLAY PANEL HAVING ELECTRODE SETS INCLUDING TRANSPARENT PROTRUSIONS

BACKGROUND OF THE INVENTION

The invention relates to an AC plasma display panel.

Plasma display panels have many advantages compared to other displays currently used: they are flat, not subject to flickering, can be viewed in a wide angle and their brightness is comparable to the brightness of cathode ray tubes. In spite of the fact that the sequential excitation of pixels (picture elements) presents more difficulties than with cathode ray tubes (CRT), they may replace, in the future, such CRTs for the display of all kinds of pictures, more particularly in television receivers.

The AC plasma display panels are either of the coplanar type or of the matrix type.

It is recalled here the principle and structure of such plasma display panels. Both types of displays comprise two insulating plates, e.g. made of glass, separated by parallel partitions constituting for instance ribs of one plate. These plates form a sealed space containing a discharge gas such as a mixture of neon and xenon. The back or front plate is covered with phosphors. In case of color displays, each pixel comprises red, green and blue phosphors. In other words, each pixel comprises three cells, one for each color.

In a matrix type panel, a first set of parallel electrodes, called row electrodes, perpendicular to the ribs, are formed on the inner side of, for instance, the back plate. Each row electrode is associated to a cell. A second set of electrodes, called column electrodes, parallel to the ribs, are formed on the inner side of the other (front) plate. To each cell is associated one row electrode and one column electrode.

It should be noted here that, in an AC display, a dielectric layer covers at least one set of electrodes.

When a high voltage pulse is applied between the row electrode and the column electrode of the cell, an electric discharge is created within this cell. This electric discharge generates ultra-violet (UV) light which excites the phosphor of the addressed cell. This visible light, resulting from the excitation of the phosphor, is viewed through the transparent front plate. The electric discharge is maintained during a controlled duration by the application of an alternate voltage (AC) between the row electrode and the column electrode. The controlled duration corresponds to the amplitude of the corresponding color component to be displayed.

As the visible light is seen through the transparent front plate, it is preferable that the column electrodes be positioned at locations which are not facing cells. This goal is achieved if the column electrodes face the edges of the ribs constituting borders between pixels.

In a known device of this type, each column electrode has an axis which is coincident with the axis of the corresponding edge of the partition wall. It has been found that, with this embodiment, there is a risk that a discharge be produced on both sides of the partition wall and, therefore, two cells may be excited at the same time. Up to now, no satisfactory solution to this problem has been found. It is the reason why this kind of device has not been used in practice for a matrix type plasma display panel.

In a coplanar plasma display panel, a first set of parallel electrodes, called column electrodes, parallel to the ribs, are associated with the back plate. Each column electrode corresponds to a cell. It is usually disposed between two ribs under the phosphor layer. A second set of electrodes, called row electrodes, perpendicular to the ribs, are associated with the transparent front plate. Two row electrodes correspond to one cell. As these row electrodes are interposed between the phosphors and the face of the front plate to be seen by the viewer, they are usually transparent, for instance made of ITO (Indium-Tin Oxide).

In order to excite the phosphors of a cell, it is necessary to convert the gas of the cell into a plasma which generates ultra-violet (UV) light. For obtaining the plasma within a cell, an addressing pulse is applied between the column electrode of this cell and one row electrode. This pulse generates charges on the walls of the cell and these wall charges are seeds for a space discharge which is generated by the application of an AC voltage (for instance of a frequency comprised between 100 kHz and 500 kHz) between the two row electrodes of the cell.

The AC voltage is maintained during a controlled duration, called sustain period, which corresponds to the amplitude of the corresponding color component to be displayed. The row electrodes are generally called sustain electrodes.

The light transmission efficiency of transparent row electrodes cannot be 100%. Therefore, a part of the emitted light is masked by these electrodes. The transparency of these electrodes may be increased by reducing their thickness; it is also possible to reduce their width. But these reductions increase the electrical resistance of the electrodes and, a high resistance of electrodes is detrimental to the efficiency and simplicity of the control circuits of the display.

The invention solves the problems mentioned here above about matrix type displays and coplanar type displays. For coplanar type displays, the invention reduces the obstacles to the path of the light between the phosphors and the display face of the panel. For matrix type displays, the invention prevents the excitation of neighboring cells without any significant obstacle on the path of the light.

SUMMARY OF THE INVENTION

According to the invention, the electrodes on the front face are facing the edges of the corresponding partition walls and they comprise transparent tongues or protrusions towards the cells to be excited.

It will be appreciated that, for matrix type displays, the provision of transparent tongues does not reduce the light energy transmitted by the display and solves the problem of the non excitation of neighboring cells by imparting to the electric field of the cell to be excited, on one side of the partition, a value which is greater than the electric field on the other side of the partition, provided that, in this case, the electric field on the other side be below the excitation threshold.

For coplanar type displays, the invention provides a significant reduction of the obstacles on the path of the emitted light, the coplanar sustain electrodes being, of course, on the back face of the display.

In an embodiment, each column electrode is disposed closer from the side of the partition wall where is located the cell to be excited, than from the other side.

In that case, the column electrodes may be bands, for instance straight bands, having their axis shifted towards the side to be excited.

The transparent protrusions or tongues are for instance made of a thin film metal, such as ITO (Indium Tin Oxide).

As the column electrodes, facing the edges of walls, are positioned in locations where they do not decrease the visibility of cells, they can be realized with a low electric resistance. This is favorable to the efficiency and simplicity of the control circuits of the display.

The invention provides a plasma display panel comprising a back substrate, a first set of parallel electrodes associated to the back substrate, a front transparent substrate, a second set of electrodes associated to the front substrate, the electrodes of the second set having a direction which is transverse with respect to the direction of the electrodes of the first set, and partition walls which are situated between the back and the front substrates, and extend in the direction of the second set of electrodes. This display is characterized in that:

each electrode of the second set faces the edge of a corresponding partition wall, and each electrode of the second set comprises, for each cell, a transparent protrusion extending towards the side of the partition wall corresponding to this cell.

In an embodiment each protrusion faces the phosphor(s) of the corresponding cell.

The length of the protrusions is, for example, a fraction of the width separating two partition walls.

In an embodiment, the axis of each electrode of the second set is shifted, with respect to the axis of the facing edge of the corresponding partition wall, towards the side of the cell to excite.

In an embodiment, each electrode of the second set is covered with black paint in the area in front of the edge of the w corresponding partition wall.

In an embodiment, where the plasma display panel is of the matrix type wherein the sustain AC voltage for each cell is provided between the corresponding electrodes of the first set and the second set, the panel comprises means for imparting to the electric field of the cell to be excited, on one side of the partition wall, a value which is greater than the value of the electric field on the other side of the partition walls, the electric field on this other side being below the excitation threshold.

In that case each protrusion may face a corresponding electrode of the first set.

According to another embodiment, the panel is of the coplanar type, wherein the electrodes of the first set are arranged by pairs, and the AC sustain voltage is provided between the electrodes of each pair; further, the protrusion is facing one electrode of the corresponding pair or the interval between the electrodes of the corresponding pair.

In this embodiment, the phosphors of the cells may be associated with the front substrate.

BRIEF DESCRIPTION OF THE DRAWINGS

Other features and advantages of the invention will appear with the description of certain of its embodiments, this description being made with reference to the following drawings, wherein.

DESCRIPTION OF PREFERRED EMBODIMENTS

Figure 1:
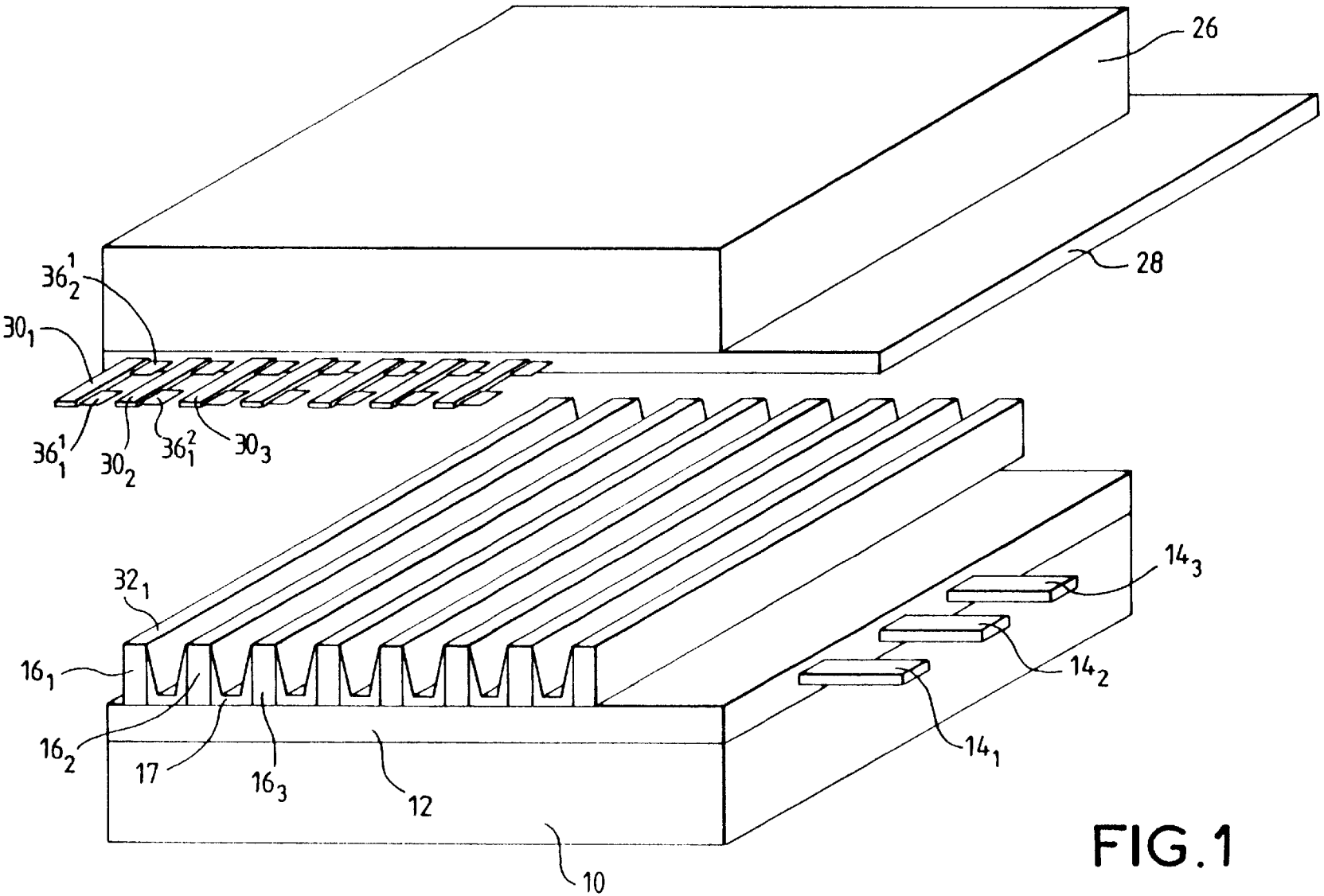
FIG. 1 is an isometric exploded view of a matrix type display panel according to the invention.
Figure 2:
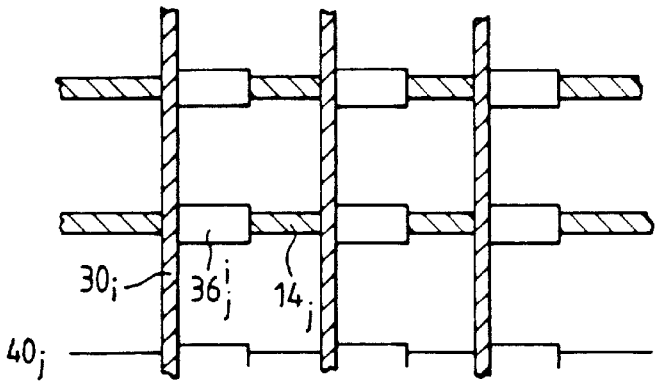
FIG. 2 shows the electrodes of the panel of FIG. 1.
Figure 3:
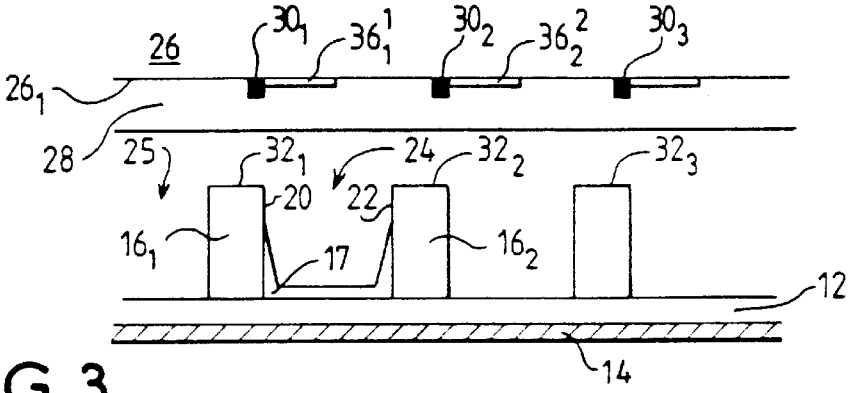
FIG. 3 is a section of the panel represented on FIG. 1.

The plasma display represented on FIGS. 1, 2 and 3 comprises a back glass substrate 10 covered by a dielectric layer 12 in which are embedded row electrodes $\mathbf{14}_1$, $\mathbf{14}_2$, $\mathbf{14}_3$, etc. These electrodes $\mathbf{14}_i$ are parallel to each other and the distance between two neighboring electrodes is constant.

The inner surface of the back substrate 10 presents ribs $\mathbf{16}_1$, $\mathbf{16}_2$, $\mathbf{16}_3$, . . . forming partition walls which, in the example, are represented attached to the substrate 10. These ribs may be formed in one piece with the back substrate 10 or with the front substrate.

These ribs $\mathbf{16}_1$, $\mathbf{16}_2$, $\mathbf{16}_3$ are perpendicular to electrodes $\mathbf{14}_i$. The distance between two neighboring ribs is constant. The interval 24 between two ribs $\mathbf{16}_1$ and $\mathbf{16}_2$ forms a groove at the bottom of which is the dielectric layer 12 covered by a phosphor 17. In the direction of the groove there is a succession of red, green and blue phosphors. The sidewalls 20, 22 of each groove 24 may be also covered with phosphors (FIG. 3).

The panel comprises also a front substrate 26 which is transparent. In the example, this substrate 26 is made of glass. The inner face of this glass substrate 26 is covered with a transparent dielectric layer 28 (FIGS. 1 and 3). Column electrodes $\mathbf{30}_1$, $\mathbf{30}_2$, $\mathbf{30}_3$, etc. are embedded in the dielectric layer 28. In the example, these column electrodes $\mathbf{30}_i$ cover the inner surface $\mathbf{26}_1$ of the glass substrate 26 and are covered by the transparent layer 28.

Each column electrode $\mathbf{30}_i$ faces the front edge $\mathbf{32}_i$ of a corresponding partition, or rib, $\mathbf{16}_i$ (FIG. 3).

As the column electrodes $\mathbf{30}_i$ are facing the partition walls and not the grooves 24, they do not limit the efficiency of the display because they are not situated in front of the phosphors 17 but in the interval between phosphors wherein no light is generated.

It is to be noted here that the wordings "column electrode" and "row electrode" are used for convenience purpose. The electrodes 14 could be designated as column electrodes and the electrodes 30 could be designated as row electrodes.

According to one aspect of the invention, the axis of each column electrode $\mathbf{30}_i$ is parallel to the axis of the corresponding partition wall $\mathbf{16}_i$ but it is shifted towards one of the grooves 24, i.e. away from the other groove 25 (FIG. 3) on the other side of the partition $\mathbf{16}_i$. In this manner, the electric field produced by the voltage between a row electrode $\mathbf{14}_i$ and a column electrode $\mathbf{30}_i$ will be higher in the groove 24 than in the groove 25. Therefore, it is possible to generate a discharge in groove 24 without producing a discharge in the neighboring groove 25.

Moreover, to each column electrode $\mathbf{30}_i$ are attached protrusions or tongues $\mathbf{36}_1{}^i$, $\mathbf{36}_2{}^i$, etc. extending above the cell to be excited. In the example represented on FIG. 3, the protrusion $\mathbf{36}_1{}^1$ is above a groove 24. It is made of a transparent material such as ITO (Indium Tin Oxide). In this embodiment, the length of the tongue $\mathbf{36}_1{}^1$ is about half the width of the groove between partitions $\mathbf{16}_1$ and $\mathbf{16}_2$.

As represented on FIG. 2, each tongues $\mathbf{36}_j{}^i$. are parallel and above the corresponding pair row electrodes $\mathbf{14}_j$. In this way, the distance between the tongues 36 and the electrodes 14 is minimized in order to maximize the electric field produced between the column electrodes and the row electrodes.

As column electrodes 30 are not transparent; they can be realized in a metal which has a low resistively and a significant cross section in order to minimize the resistance and, therefore, minimize losses and deformations of the pulses applied to these electrodes.

The transparent tongues 36 have a higher resistance. However, these tongues do not increase significantly the resistance of the bus or column electrodes.

The plasma display panel operates as follows:

To each cell $\mathbf{40}_{ij}$ (FIG. 2) corresponds one row electrode $\mathbf{14}_j$, and one column electrode $\mathbf{30}_i$ (FIG. 2). When a high voltage pulse is applied between the electrode $\mathbf{30}_i$ and the electrode $\mathbf{14}_j$, the gas in the cell $\mathbf{40}_{ij}$ is excited and produces a discharge generating ultraviolet (UV) light. This UV light excites the phosphors 17. The discharge and the UV light is maintained after the disappearance of the pulse by applying a lower AC voltage between the row electrode $\mathbf{14}_j$ and the column electrode $\mathbf{30}_i$ and this UV light disappears when the AC voltage is no more applied between said electrodes.

This kind of display, where the maintenance voltage is produced between row electrodes and column electrodes, is called, as mentioned above, a "matrix type" plasma display panel.

The plasma display represented on FIGS. 4–7 is of the coplanar type.

It comprises a back glass substrate 10 covered by a dielectric layer 12 in which are embedded row sustain electrodes $\mathbf{14}_{11}$, $\mathbf{14}_{12}$, $\mathbf{14}_{21}$, $\mathbf{14}_{23}$, etc. These electrodes $\mathbf{14}_{j1}$, $\mathbf{14}_{j2}$, are parallel to each other and form pairs. The distance d (FIG. 5) between two electrodes of the same pair is smaller than the distance D between two pairs.

The inner surface of the back substrate 10 (FIG. 4) presents ribs $\mathbf{16}_1$, $\mathbf{16}_2$, $\mathbf{16}_3$, . . . forming partition walls which, in the example, are represented attached to the substrate 10. These ribs may be formed in one piece with the back substrate 10 or with the front substrate.

These ribs $\mathbf{16}_1$, $\mathbf{16}_2$, $\mathbf{16}_3$ are perpendicular to electrodes $\mathbf{14}_{j1}$, $\mathbf{14}_{j2}$. The distance between two neighboring ribs is constant. The interval 24 between two ribs $\mathbf{16}_1$ and $\mathbf{16}_2$ forms a groove at the top of which is a dielectric layer covered by a phosphor 17. In the direction of the groove, there is a succession of red, green and blue phosphors. The sidewalls 20, 22 of each groove 24 may be also covered with phosphors.

The panel comprises also a front substrate 26 which is transparent. In the example, this substrate 26 is made of glass. The inner face of this glass substrate 26 is covered with a transparent dielectric layer 28 which receives the phosphor 17. The column electrodes $\mathbf{30}_1$, $\mathbf{30}_2$, $\mathbf{30}_3$, etc. are embedded in the dielectric layer 28. In the example, these column electrodes $\mathbf{30}_i$ cover the inner surface $\mathbf{26}_1$ of the glass substrate 26 and are covered by the transparent layer 28.

Each column electrode $\mathbf{30}_i$ faces the front edge $\mathbf{32}_i$ of a corresponding partition, or rib, $\mathbf{16}_i$.

Like in the first embodiment, the axis of each column electrode $\mathbf{30}_i$ is parallel to the axis of the corresponding partition wall $\mathbf{16}_i$ but it is shifted towards one of the grooves 24, i.e. away from the other groove 25 on the other side of the partition $\mathbf{16}_i$.

Figure 5:
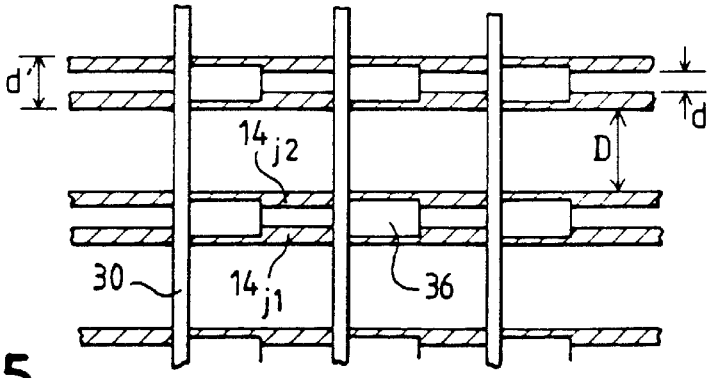
FIG. 5 is a view similar to FIG. 2, but for the embodiment of FIG. 4.
Figure 4:
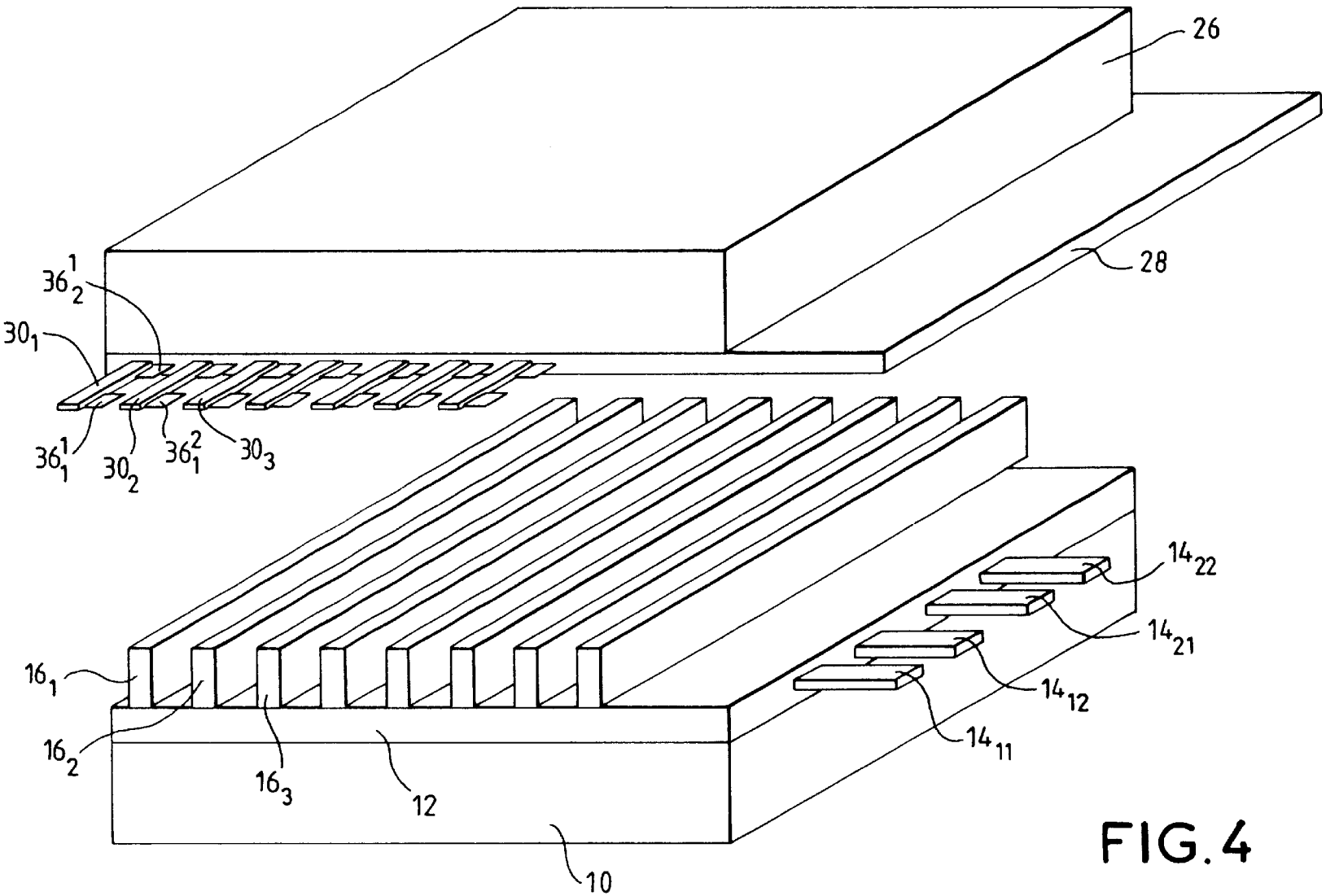
FIG. 4 is a view similar to FIG. 1 for a coplanar type display panel according to the invention.
Figure 6:
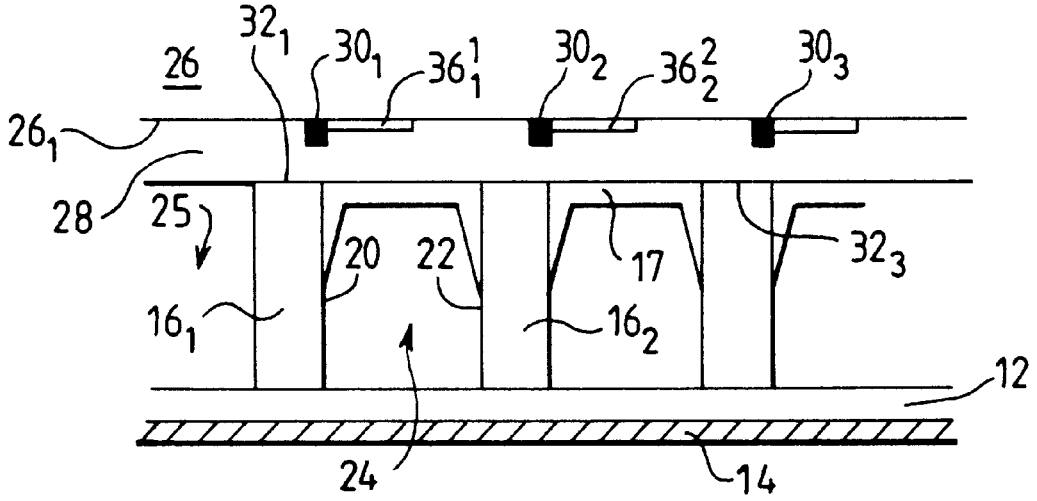
FIG. 6 is a view similar to FIG. 3 for the embodiment of FIG. 4, and FIG. 7 corresponds to a variant of FIG. 5.

As represented on FIG. 5, each tongue $\mathbf{36}_j^i$ is parallel and above the corresponding pair of row electrodes $\mathbf{14}_j^1$ and $\mathbf{14}_j^2$ In this way, the distance between the tongues 36 and the electrodes 14 is minimized in order to maximize the electric field produced between the column electrodes and the row electrodes.

Figure 7:
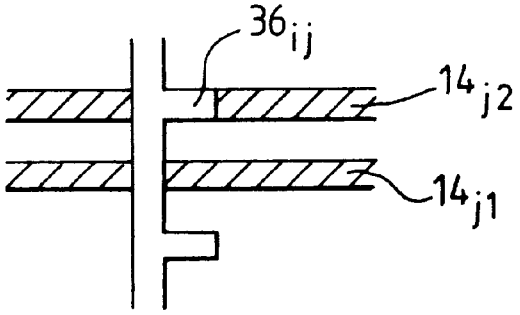

The best result is obtained with the embodiment of FIG. 7 where the tongue 36 is right above address (and sustain) electrode $\mathbf{14}_j^2$ and not above sustain electrode $\mathbf{14}_j^1$.

In the embodiment of FIG. 5, the tongue 36 has a width slightly greater than the width d separating the electrodes $\mathbf{14}_j^1$ and $\mathbf{14}_j^2$ but inferior to the width d' separating the two external edges of the electrodes $\mathbf{14}_{j1}$, and $\mathbf{14}_{j2}$.

In another embodiment (not shown), which may be used in both embodiments represented on FIGS. 5 and 7, the electrodes 30 have an axis which is in the medium plane of the partition wall 16. In that case, the correct cell is excited because of the presence of the tongue 36.

Column electrodes 30 are not transparent; they can be realized in a metal which has a low resistively and a significant cross section in order to minimize the resistance and, therefore, minimize losses and deformations of the pulses applied to these electrodes.

The transparent tongues 36 have a higher resistance. However, these tongues do not increase significantly the resistance of the bus or column electrodes.

The plasma display panel operates as follows:

To each cell $\mathbf{40}_{ij}$ (FIG. 5) corresponds two row electrodes $\mathbf{14}_{j1}$ and $\mathbf{14}_{j2}$, and one column electrode $\mathbf{30}_i$. When a high voltage pulse is applied between the electrode $\mathbf{30}_i$ and the electrode $\mathbf{14}_{j2}$, electric charges are produced on the walls of the cell. These charges constitute seeds for a discharge of the gas (Xe and Ne) inside the cell. When an AC voltage is applied between sustain electrodes $\mathbf{14}_{j1}$ and $\mathbf{14}_{j2}$, the gas in the cell $\mathbf{40}_{ij}$ is excited and produces a discharge generating ultraviolet (UV) light. This UV light excites the phosphors 17. This UV light disappears when the AC voltage is no more applied between said electrodes.

For both embodiments, in order to improve the contrast of the display, it is possible to cover with black paint the w column electrodes 30 above the edges $\mathbf{32}_i$ of the partition walls $\mathbf{16}_i$.

The plasma display according to the invention is efficient, i.e. there is no loss of light, because no electrode (or electrodes of minimum area) hides each cell. Moreover, the resistance of the electrodes can be minimized; therefore, there is no degradation of the pulses applied to the electrodes.

What is claimed:

1. A plasma display panel comprising a back substrate, a first set of parallel electrodes associated to the back substrate, a front transparent substrate, a second set of electrodes associated to the front substrate, the electrodes of the second set having a direction which is transverse with respect to the direction of the electrodes of the first set, the association of one electrode of the first set with each electrode of the second set forming a cell, and partition walls which are situated between the back and the front substrates, and extend in the direction of the second set of electrodes characterized in that:

each electrodes of the second set faces the edge of a corresponding partition wall, whereby two adjacent electrodes of the second set face the edge of different partition walls, and each electrode of the second set comprises, for each cell, a transparent protrusion extending towards the side of the partition wall corresponding to this cell.

2. A plasma display panel according to claim 1, characterized in that in a color display each cell comprises a specific phosphor and each protrusion faces the phosphor(s) of the corresponding cell.

3. A plasma display panel according to claim 1, characterized in that each protrusion is made of a thin film metal, wherein such metal is transparent.

4. A plasma display panel according to claim 1, characterized in that the length of the protrusions is a fraction of the width separating two partition walls.

5. A plasma display panel according to claim 1, characterized in that the axis of each electrode of the second set is shifted, with respect to the axis of the facing edge of the corresponding partition wall, towards the side of the cell to excite.

6. A plasma display panel according to claim 1, characterized in that each electrode of the second set is covered with black paint in the area in front of the edge of the corresponding partition wall.

7. A plasma display panel according to claim 1, characterized in that it is of the matrix type wherein a sustain AC voltage for each cell is provided between the corresponding electrodes of the first set and the second set to produce an electric field inside this cell that makes possible to generate discharge in the cells to be excited and it comprises means for imparting to this electric field, on one side of the partition walls, a value which is greater than the value of this electric field on the other side of the partition walls, the value of this electric field on this other side being below the excitation threshold.

8. A plasma display panel according to claim 7, characterized in that each protrusion is facing a corresponding electrode of the first set.

9. A plasma display panel according to claim 1, characterized in that said panel is of the coplanar type, the electrodes of the first set being arranged by pairs, an AC sustain voltage being provided between the electrodes of each pair, and wherein the protrusion is facing one electrode of the corresponding pair or the interval between the electrodes of the corresponding pair.

10. A plasma display panel according to claim 9, characterized in that the front substrate is covered with phosphors.

11. A plasma display panel according to claim 1, wherein each protrusion is made of a thin film of Indium Tin Oxide.

* * * * *